US008020639B2

(12) United States Patent
Wells et al.

(10) Patent No.: US 8,020,639 B2
(45) Date of Patent: Sep. 20, 2011

(54) CUTTING REMOVAL SYSTEM FOR PDC DRILL BITS

(75) Inventors: Michael R. Wells, Lakewood, CO (US); Tim K. Marvel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 154 days.

(21) Appl. No.: 12/341,525

(22) Filed: Dec. 22, 2008

(65) Prior Publication Data

US 2010/0155150 A1 Jun. 24, 2010

(51) Int. Cl.
*E21B 10/38* (2006.01)
*E21B 10/60* (2006.01)

(52) U.S. Cl. ..... 175/429; 175/431; 175/340; 175/393

(58) Field of Classification Search ..... 175/429, 175/431, 340, 393
See application file for complete search history.

(56) References Cited

U.S. PATENT DOCUMENTS

| | | | | |
|---|---|---|---|---|
| 3,938,599 | A | 2/1976 | Horn | |
| 5,197,554 | A | 3/1993 | Zigsling | |
| 5,582,258 | A * | 12/1996 | Tibbitts et al. | 175/57 |
| 6,065,553 | A * | 5/2000 | Taylor | 175/429 |
| 6,135,218 | A * | 10/2000 | Deane et al. | 175/425 |
| 6,164,394 | A | 12/2000 | Mensa-Wilmot et al. | |
| 6,164,395 | A * | 12/2000 | Fuller et al. | 175/431 |
| 6,651,756 | B1 * | 11/2003 | Costo et al. | 175/374 |
| 2008/0029312 | A1 | 2/2008 | Hall et al. | |
| 2008/0128169 | A1 * | 6/2008 | Radford et al. | 175/57 |
| 2008/0149393 | A1 | 6/2008 | McClain et al. | |

FOREIGN PATENT DOCUMENTS

| | | |
|---|---|---|
| EP | 0656458 | 6/1995 |
| WO | 97/07913 A1 | 3/1997 |

* cited by examiner

*Primary Examiner* — Giovanna C Wright
(74) *Attorney, Agent, or Firm* — Steve Rosenblatt

(57) ABSTRACT

The blades of a PDC bit have a nozzle between them preferably oriented laterally across the plane of the cutters on the blade and more preferably in a trough disposed adjacent the row of cutters. The cutting is less likely to adhere to the bit surface because the trough abruptly spaces back the bit surface and the spray being oriented radially preferably into the trough gets between the bit surface and the cutting before it can adhere to the bit surface using the fluid energy to drive the cutting into the junk slot.

17 Claims, 1 Drawing Sheet

CUTTING REMOVAL SYSTEM FOR PDC DRILL BITS

FIELD OF THE INVENTION

The field of the invention is drill bits for drilling oil or gas wells and more particularly a cuttings removal assembly for a polycrystalline diamond compact (PDC) type of drill bits.

BACKGROUND OF THE INVENTION

A long standing problem with drill bits is a phenomenon known as balling. The cutters on the drill bit shear the rock as the bit is rotated. As a result of such a shearing action, a cutting is generated that is comprised of formation particles encapsulated by fines from the drilling fluid. This encapsulation creates a filter cake that results in a differential pressure between the interior and exterior of the cutting thereby giving the cutting structural strength. This gives the cutting both strength and ductility thereby making the cutting difficult to weaken and clear from the cutting elements. In addition, the cuttings when under such pressure have an affinity for the bit surface adjacent to the cutters. In a PDC bit the cuttings tend to accumulate in the junk slots between blades. This accumulation leads to a phenomenon known as balling that occurs when a sufficient volume of cuttings have accumulated to cut off the fluid flow out of the junk slot. This can then lead to a situation where the cuttings are being extruded out the junk slot due to the high forces exerted on the drill bit rather than the preferred scenario where they are evacuated by the drilling fluid. It has been shown that balling even in a single junk slot on a 6 bladed PDC bit can reduce the rate of penetration (ROP) by as much as 80%.

The drilling mud is normally circulated through a bit body and exits at nozzle locations between adjacent blades. Prior designs tended to point those nozzles toward the hole bottom due to limitations imposed by manufacturing. This technique cleans the junk slots of drill cuttings in varying degrees, depending on a host of factors including, but not limited to, the formation being drilled, the rate of penetration, the mud system in use, and various design aspects of the PDC bit. More recent developments in PDC bits have attempted to vary the angle of the fluid jet from the nozzles to about 45 degrees away from the vertical bit axis. Such a design is shown in U.S. Pat. No. 6,164,394. Even earlier a company called British Bits advertised a lateral stream from a nozzle directed radially between blades. Yet other designs for an impregnated diamond bit featured flow channels for cooling and cuttings removal with the hope that radial flow would turn 90 degrees and take cuttings between the teeth. This design is shown in U.S. Pat. No. 3,938,599. Other designs of laterally oriented nozzles are shown in WO 97/07913.

While turning the nozzles away from the axial orientation toward the hole bottom may have provided some incremental reduction in bit balling, the results were difficult to quantify. One thing that the lateral orientation standing alone did not address is how to get the cutting to release from the bit surface as it is produced at the cutter. Rather than letting the bit surface contact the cutting right after it is made at the cutter, the present invention takes the approach that there is a benefit to spacing the surface of the bit away from the region where the cutting is formed. There is a further benefit in orienting the spray of a nozzle behind the cutting before it engages the bit surface. One way this is done in the preferred embodiment is to dispose a trough adjacent the cutters so as to make the bit surface recede as the cutting is formed and at the same time orient the spray in the trough to provide fluid energy to keep the newly formed cutting away from the bit surface and propelling it radially into the junk slot. These and other features of the present invention will be more apparent to those skilled in the art from a review of the preferred embodiment and the associated drawings that appear below, while recognizing that the full scope of the invention is to be found in the literal and equivalent scope of the claims.

SUMMARY OF THE INVENTION

The blades of a PDC bit have a nozzle between them preferably oriented laterally across the plane of the cutters on the blade (radially outward) and more preferably in a trough disposed adjacent to the row of cutters. The cutting is less likely to adhere to the bit surface when produced because the trough abruptly spaces back the bit surface and the jet stream being oriented, at least in part, radially in the trough is forced between the bit surface and the cutting to use the fluid energy to drive the cutting into the free flow of the junk slot where it is more easily evacuated.

DETAILED DESCRIPTION OF THE PREFERRED EMBODIMENT

Figure 1:
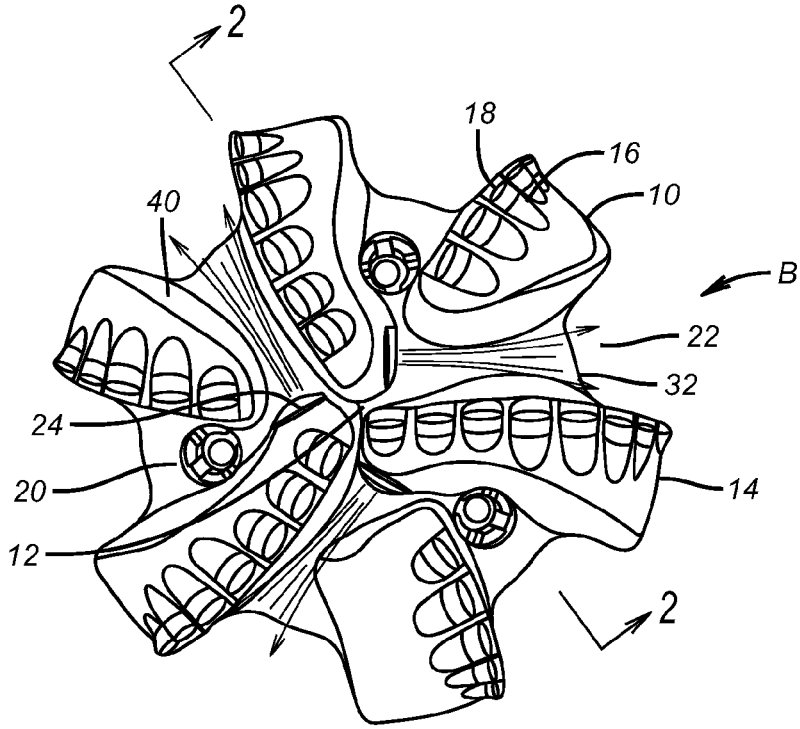
FIG. 1 is a bottom view of a PDC bit showing the lateral orientation of the nozzles.

Referring to FIG. 1 a 6 blade version of a PDC bit is illustrated in a bottom view looking up. It has six blades 10 that start at the bottom center 12 and curve around to the outside 14 of the bit B along a curved path. A plurality of compacts 16 is disposed on a leading face 18. Valleys 20 are formed between blades 10 that continue up the side of the bit to define a passage 22 known as a junk slot. This pattern is repeated between blade pairs. A nozzle 24 is typically located between blade pairs. What has thus far been described represents a PDC bit that is well known in the art.

What is unique is that the nozzle 24 has its outlet oriented laterally generally in alignment with the blade front 18 along the bit bottom. The outlet is somewhat forward of the blade front simply by virtue of the placement of the nozzle 24 on the back of another blade 10 located two blades away from the junk slot 20 into which the particular nozzle 24 is directed in the FIG. 1 example. Each nozzle 24 preferably delivers a cone shaped spray pattern so as to impact as much of a particular junk slot 20 as possible. However, more general streams emanating from the nozzle 24 are also envisioned.

Figure 2:
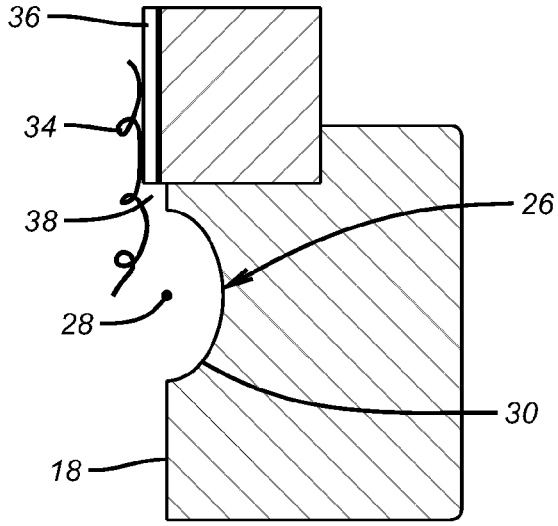
FIG. 2 is a sectional elevation view of a trough adjacent the row of compacts on a blade of a PDC bit taken along line 2-2 of FIG. 1

Shown in FIG. 2 is a trough 26 formed in the bit B and adjacent the compacts 16 that are on the front 18 of a blade 10. Preferably the trough 26 follows the form of the bit B along the bottom and is spaced as closely as practical to the row of compacts 16 without undermining the structural integrity of their fixation to the bit B. The trough can have a longitudinal axis 28 that tracks the profile of the compacts 16 into the junk slot 22 while maintaining a generally arcuate shape 30 that has a constant depth from axis 28 that is located on the blade front 18. Alternatively, the trough 26 can have a variable depth from axis 28 and a generally radial orientation and terminate on a blade front 18 before or at the outer surface 32 of the body of bit B.

Preferably, the spray stream from nozzle 24 is directed into the trough 26 at a point as close to the bottom center of the bit B as possible and perpendicular to the body of the bit B. If the bit configuration allows it, the nozzle outlet would ideally be aligned with the axis 28 of the trough 26 or even further closer in to the arcuate surface 30 that defines the trough 26. In that way as a cutting 34 is formed off the cutting face 36 there is quickly developed a gap 38 behind it by the presence of the arcuate surface 30 which is one step to fighting the tendency of the cutting 34 to adhere to any part of the bit B as the cutting is formed. The fact that the energy of the spray coming from nozzle 24 is also acting in trough 26 and behind the cutting 34 will further aid in reducing or eliminating the tendency to ball in the junk slot 20. The trough 26 can be arcuate in section as shown in FIG. 2 or it can have other cross-sectional shapes including sharp angles. Its axis 28 can be a series of slopes, a continuous arc or more of a straight line and its depth can be constant or variable, getting smaller toward the outer portion of the bit. Optionally, a trough such as 26 can be placed on opposed blades across a junk slot 20. Flow diverters in the junk slot 20 that direct the nozzle stream from nozzle 24 into the trough 26 can be employed such as for example extending sloping face or faces 40 across the junk slot 20 from trough 26. Preferably the front face 36 of the compacts 16 is somewhat forward in the direction of rotation from axis 28. The arcuate or other shape of the trough bottom 30 can be polished or can have coatings or other surface features that tend to reduce the tendency of the cutting 34 to adhere to it.

The above description is illustrative of the preferred embodiment and many modifications may be made by those skilled in the art without departing from the invention whose scope is to be determined from the literal and equivalent scope of the claims below.

We claim:

1. A drill bit for making a wellbore, comprising:

a plurality of blades extending from a body, each blade further comprising a plurality of compacts mounted to the blade periphery and a junk slot defined by adjacent blades;

a nozzle disposed adjacent said junk slot;

a trough on a blade, said trough having a length extending past a plurality of said compacts; said nozzle comprises an outlet directed toward said length of said trough.

2. The bit of claim 1, wherein:

said trough extends generally parallel to said compacts along the bottom of said body.

3. The bit of claim 1, wherein:

said trough is located as close as possible to said compacts without undermining the mounting of said compacts to said body.

4. The bit of claim 1, wherein:

said trough has a constant depth along the length thereof.

5. The bit of claim 1, wherein:

said trough has a variable depth along a length thereof.

6. The bit of claim 1, wherein:

said trough cross-sectional shape is arcuate.

7. The bit of claim 1, wherein:

said trough extends radially with respect to a longitudinal axis of said body and decreases in depth in a direction away from said longitudinal axis of said body.

8. The bit of claim 1, wherein:

said trough curves along a blade tracking the compacts adjacent its periphery.

9. The bit of claim 1, wherein:

said blade on the opposite side of said junk slot from said trough is configured to deflect nozzle flow into said trough.

10. The bit of claim 1, wherein:

said nozzle has an outlet whose axis is in said trough.

11. The bit of claim 1, wherein:

said trough comprises surface treatment designed to minimize sticking of cuttings thereto.

12. The bit of claim 1, wherein:

said nozzle has an outlet that is perpendicular to the longitudinal axis of said body.

13. The bit of claim 1, wherein:

said compacts have a cutting face that extends forward of the blade face in the direction of bit rotation and forward of said adjacent trough.

14. The bit of claim 1, wherein:

said trough changes shape along its length.

15. The bit of claim 9, wherein:

said nozzle creates a spray pattern that spans said trough.

16. The bit of claim 1, wherein:

the shape of said trough is other than arcuate.

17. The bit of claim 1, wherein:

said trough further comprises an axis that extends in a straight line.

* * * * *